US012378622B2

(12) United States Patent
Zhang et al.

(10) Patent No.: US 12,378,622 B2
(45) Date of Patent: Aug. 5, 2025

(54) HIGH-STRENGTH STEEL BAR AND PRODUCTION METHOD THEREOF

(71) Applicants: INSTITUTE OF RESEARCH OF IRON & STEEL, JIANGSU PROVINCE/SHA-STEEL, CO., LTD., Suzhou (CN); ZHANGJIAGANG HONGCHANG STEEL PLATE CO., LTD., Suzhou (CN); JIANGSU SHAGANG GROUP CO., LTD., Suzhou (CN)

(72) Inventors: Yu Zhang, Suzhou (CN); Han Ma, Suzhou (CN); Yun Zhou, Suzhou (CN); Huande Chen, Suzhou (CN)

(73) Assignees: INSTITUTE OF RESEARCH OF IRON & STEEL, JIANGSU PROVINCE/SHA-STEEL, CO., LTD., Suzhou (CN); HANGJIAGANG HONGCHANG STEEL PLATE CO., LTD., Suzhou (CN); JIANGSU SHAGANG GROUP CO., LTD., Suzhou (CN)

( * ) Notice: Subject to any disclaimer, the term of this patent is extended or adjusted under 35 U.S.C. 154(b) by 795 days.

(21) Appl. No.: 17/613,917

(22) PCT Filed: Jul. 22, 2019

(86) PCT No.: PCT/CN2019/096977
§ 371 (c)(1),
(2) Date: Nov. 23, 2021

(87) PCT Pub. No.: WO2020/232818
PCT Pub. Date: Nov. 26, 2020

(65) Prior Publication Data

US 2022/0220573 A1 Jul. 14, 2022

(30) Foreign Application Priority Data

May 23, 2019 (CN) ..... 201910434471.6

(51) Int. Cl.

| | |
|---|---|
| ***C21D 9/00*** | (2006.01) |
| ***B22D 11/115*** | (2006.01) |
| ***C21D 6/00*** | (2006.01) |
| ***C21D 8/06*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C21D 9/0075* (2013.01); *B22D 11/115* (2013.01); *C21D 6/004* (2013.01); *C21D 6/005* (2013.01); *C21D 6/008* (2013.01); *C21D 8/065* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/002* (2013.01); *C21D 2211/005* (2013.01); *C21D 2211/009* (2013.01)

(58) Field of Classification Search
CPC ..... C21D 9/0075; C21D 6/004; C21D 6/005; C21D 6/008; C21D 8/065; C21D 2211/002; C21D 2211/005; C21D 2211/009; C21D 8/08; C22C 38/02; C22C 38/04; C22C 38/06; C22C 38/44; C22C 38/46; C22C 38/48; C22C 38/50; C22C 38/54; B22D 11/115; C21C 7/072
USPC ..... 148/529
See application file for complete search history.

(56) References Cited

U.S. PATENT DOCUMENTS

2015/0041029 A1* 2/2015 Yamashita ..... C22C 38/24 420/104

FOREIGN PATENT DOCUMENTS

| | | | |
|---|---|---|---|
| CN | 102732787 A | | 10/2012 |
| CN | 102796962 A | | 11/2012 |
| CN | 104451410 A | * | 3/2015 |

OTHER PUBLICATIONS

CN-104451410-A Translation (Year: 2015).*

* cited by examiner

*Primary Examiner* — Danielle M. Carda
(74) *Attorney, Agent, or Firm* — Muncy, Geissler, Olds & Lowe. P.C.

(57) ABSTRACT

Disclosed are a high-strength steel bar and a production method therefor. The high-strength steel bar comprises, by mass percentage, the following chemical components: C: 0.15-0.32%, Si+Mn: 0.5-1.9%, Mn+Cr+Mo+Ni: 1.1-2.1%, V: 0.02-0.8%, at least one of Nb, Ti and Al: 0.01-0.3%, and the balance of Fe and inevitable impurities; wherein Mn=(2.5-3.5)Si, and a carbon equivalent satisfies Ceq=C+Mn/6+(Cr+Mo+V)/5+(Cu+Ni)/15≤0.56%.

16 Claims, No Drawings

HIGH-STRENGTH STEEL BAR AND PRODUCTION METHOD THEREOF

The present application is a 35 U.S.C. § 371 National Phase conversion of International (PCT) Patent Application No. PCT/CN2019/096977, filed on Jul. 22, 2019, which claims priority to Chinese Patent Application No. 201910434471.6, filed on May 23, 2019 and tiled "HIGH-STRENGTH STEEL BAR AND PRODUCTION METHOD THEREOF", which is incorporated herein by reference in its entirety. The PCT International Patent Application was filed and published in Chinese.

TECHNICAL FIELD

The present invention belongs to the technical field of steel and iron materials, and relates to a high-strength steel bar and a production method thereof.

BACKGROUND

During use of low-level steel bars (including ordinary steel bars), not only is consumption of steel materials increased, consumption of resources and energy is caused, burdens on the environment are increased, but also due to an obvious yield platform and low strength, large plastic deformation is caused in a yield stage when the tensile force is not increased, and thus the safety of a building is seriously affected. Since related requirements of safety levels of major protection projects and other structures are constantly improved, low-level steel bars are unable to fully meet the requirements, and thus high-strength steel bars (such as large deformation resistant steel bars) are produced as required.

SUMMARY

An objective of the present invention is to provide a high-strength steel bar and a production method thereof, and the steel bar has high strength and no obvious yield platform.

To fulfill said objective of the present invention, the present invention provides a high-strength steel bar comprising, by mass percentage, the following chemical components: C: 0.15-0.32%, Si+Mn: 0.5-1.9%, Mn+Cr+Mo+Ni: 1.1-2.1%, V: 0.02-0.8%, at least one of Nb, Ti and Al: 0.01-0.3%, and the balance of Fe and inevitable impurities; wherein Mn=(2.5-3.5)Si, and a carbon equivalent satisfies Ceq=C+Mn/6+(Cr+Mo+V)/5+(Cu+Ni)/15≤0.56%.

As an improvement of an embodiment of the present invention, the high-strength steel bar comprises, by mass percentage, the following chemical components: C: 0.15-0.29%, Si+Mn: 0.5-1.8%, Mn+Cr+Mo+Ni: 1.1-2.0%, V: 0.05-0.8%, at least one of Nb, Ti and Al: 0.01-0.3% and the balance of Fe and inevitable impurities; wherein Mn=(2.5-3.5)Si, and the carbon equivalent satisfies Ceq=C+Mn/6+(Cr+Mo+V)/5+(Cu+Ni)/15≤0.54%.

As an improvement of an embodiment of the present invention, the high-strength steel bar comprises, by mass percentage, the following chemical components: C: 0.15-0.32%, Si+Mn: 0.5-1.6%, Cr: 0.3-0.6%, Mn+Cr+Mo+Ni: 1.3-2.0%, V: 0.02-0.8%, at least one of Nb, Ti and Al: 0.01-0.3% and the balance of Fe and inevitable impurities; wherein Mn=(2.5-3.5)Si, and the carbon equivalent satisfies Ceq=C+Mn/6+(Cr+Mo+V)/5+(Cu+Ni)/15≤0.56%.

As an improvement of an embodiment of the present invention, the high-strength steel bar comprises, by mass percentage, the following chemical components: C: 0.15-0.32%, Si+Mn: 0.5-1.9%, Mn+Cr+Mo+Ni: 1.3-2.1%, V: 0.02-0.8%, B: 0.0008-0.002%, at least one of Nb, Ti and Al: 0.01-0.3% and the balance of Fe and inevitable impurities; wherein Mn=(2.5-3.5)Si, and the carbon equivalent satisfies Ceq=C+Mn/6+(Cr+Mo+V)/5+(Cu+Ni)/15≤0.56%.

As an improvement of an embodiment of the present invention, the high-strength steel bar comprises, by mass percentage, the following chemical components: C: 0.15-0.32%, Si+Mn: 0.5-1.9%, Mn+Cr+Mo+Ni: 1.1-2.1%, V: 0.02-0.8%, B: 0.0008-0.002%, at least one of Nb and Al: 0.01-0.3%, Ti: 0.01-0.1% and the balance of Fe and inevitable impurities; wherein Ti/N≥1.5, Mn=(2.5-3.5)Si, and the carbon equivalent satisfies Ceq=C+Mn/6+(Cr+Mo+V)/5+(Cu+Ni)/15≤0.56%.

As an improvement of an embodiment of the present invention, the cross-sectional diameter of the high-strength steel bar is 14-18 mm, the content of C is 0.15-0.3% by mass percentage, and the carbon equivalent Ceq is 0.40-0.52%; or, the cross-sectional diameter of the high-strength steel bar is 20-22 mm, the content of C is 0.15-0.3% by mass percentage, and the carbon equivalent Ceq is 0.52-0.54%.

As an improvement of an embodiment of the present invention, the microstructure of the high-strength steel bar comprises ferrite, pearlite, bainite and a precipitated phase.

As an improvement of an embodiment of the present invention, the ferrite has a volume percentage of 5-35% and a size of 2-15 μm, the pearlite has a volume percentage of 30-70%, the bainite has a volume percentage of 5-35% and a size of 5-25 μm, and the precipitated phase has a size≤100 nm and a volume content≥$2*10^5/mm^3$.

As an improvement of an embodiment of the present invention, the ferrite has a volume percentage of 8-30% and a size of 3-12 μm, the pearlite has a volume percentage of 35-65%, the bainite has a volume percentage of 8-40% and a size of 6-22 μm, and the precipitated phase has a size≤80 nm and a volume content≥$5*10^5/mm^3$.

As an improvement of an embodiment of the present invention, the ferrite has a volume percentage of 10-25% and a size of 4-10 μm, the pearlite has a volume percentage of 40-60%, the bainite has a volume percentage of 15-35% and a size of 8-20 μm, and the precipitated phase has a size≤60 nm and a volume content≥$8*10^5/mm^3$.

As an improvement of an embodiment of the present invention, the high-strength steel bar has no obvious yield platform in a stress-strain curve of a tensile test, the yield strength≥600 MPa, the yield ratio≤0.78, the elongation after fracture≥25%, the uniform elongation≥15%, and the impact toughness≥160 J under a test condition of −20° C.

As an improvement of an embodiment of the present invention, the high-strength steel bar comprises a base material and a flash butt welding junction, and the high-strength steel bar has a fracture point formed at the base material in a tensile test.

To fulfill said objective of the present invention, the present invention provides a production method of the high-strength steel bar, the production method comprises the following steps:

a smelting process: performing smelting on molten steel in an electric furnace or a converter;

a continuous casting process: preparing the molten steel into a continuous casting billet through a continuous casting machine, wherein the superheat degree of the molten steel during continuous casting is 15-30° C.;

a temperature-controlled rolling process: rolling the continuous casting billet into the steel bar in a heating furnace at a heating temperature of 1200-1250° C. for 60-120 min, wherein the initial rolling temperature is 1000-1150° C., and the finish rolling temperature is 850-950° C.;

a temperature-controlled cooling process: cooling the steel bar at a temperature of 800-920° C. on a cooling bed.

As an improvement of an embodiment of the present invention, the smelting process comprises an argon blowing refining process, and according to the argon blowing refining process, argon bottom blowing at a pressure of 0.4-0.6 MPa is used to perform soft stirring on the refined molten steel for not less than 5 min.

As an improvement of an embodiment of the present invention, the molten steel is subjected to electromagnetic stirring during continuous casting with an electromagnetic stirring parameter of 300 A/4 Hz and a final electromagnetic stirring parameter of 480 A/10 Hz.

As an improvement of an embodiment of the present invention, in the continuous casting process, the straightening temperature of the continuous casting billet≥850° C.

As an improvement of an embodiment of the present invention, in the temperature-controlled cooling process, the steel bar at a temperature of 820-900° C. is cooled on the cooling bed at a cooling rate of 2-5° C./s.

Compared with the prior art, the present invention has the following beneficial effects: a reasonable alloying design of C, Si, Mn, Cr, Mo and Ni is adopted and combined with a microalloying design of Nb, V, Ti and Al, so that fine control over the microstructure is achieved; the steel bar has no obvious yield platform in a stress-strain curve of a tensile test, the yield strength≥600 Mpa, the yield ratio≥0.78, and continuous work hardening and uniform plastic deformation occur after the yield strength is reached so that the external disturbance resistance of a building can be significantly improved; in addition, the elongation after fracture≥25%, and the uniform elongation≥15% and is significantly higher than that of ordinary steel bars and seismic steel bars, so that great improvement of the deformation resistance of the building is facilitated; the impact toughness of the high-strength steel bar≥160 J under a test condition of −20° C. and is significantly higher than that of ordinary steel bars and seismic steel bars, and the high-strength steel bar absorbs more energy during deformation due to high toughness, so that the damage resistance of the building is improved; moreover, due to a low-carbon equivalent design of the high-strength steel bar, performance improvement during cold bending, welding and other processing applications is ensured.

DETAILED DESCRIPTION

As described in the background, low-level steel bars (including ordinary steel bars and even some seismic steel bars) have obvious yield platforms, low strength and other problems and cannot meet constantly improved requirements of safety levels. Based on this situation, the inventor provides a high-strength steel bar with good comprehensive strength performance and no obvious yield platform and a production method thereof. Due to excellent performance, the high-strength steel bar can also be called a large deformation resistant steel bar.

Specifically, in an implementation of the present invention, the high-strength steel bar includes, by mass percentage, the following chemical components: C: 0.15-0.32%, Si+Mn: 0.5-1.9%, Mn+Cr+Mo+Ni: 1.1-2.1%, V: 0.02-0.8%, at least one of Nb, Ti and Al: 0.01-0.3% and the balance of Fe and inevitable impurities; where Mn=(2.5-3.5)Si, and a carbon equivalent satisfies Ceq=C+Mn/6+(Cr+Mo+V)/5+(Cu+Ni)/15≤0.56%.

Based on a large amount of test data, the chemical components of the high-strength steel bar are described in detail below.

C: As one of important alloying elements in steel materials, C directly affects the strength of the steel bar. When the mass percentage of C is lower than 0.15%, the strength of the steel bar is greatly reduced; when the mass percentage of C is higher than 0.32%, the carbon equivalent of the steel bar is increased, and the low-temperature toughness and weldability of the steel bar are greatly reduced; moreover, when the carbon equivalent is not higher than 0.56%, the strength and welding technological performance of the steel bar can be guaranteed. Therefore, in this implementation, the mass percentage of C is controlled to be 0.15-0.32%, and the carbon equivalent satisfies Ceq=C+Mn/6+(Cr+Mo+V)/5+(Cu+Ni)/15≤0.56%.

Si and Mn: The hardenability of steel materials can be improved by adding Si and Mn, and a certain proportion of pearlite and bainite can be generated in the microstructure of the steel bar. When the mass percentage of Si+Mn is lower than 0.5%, the steel bar has difficulty in forming the bainite and low strength; when the mass percentage of Si+Mn is higher than 1.9%, the steel bar is likely to have a too high proportion of the bainite, a low proportion of the pearlite, a high yield ratio and low elongation. Therefore, in this implementation, the mass percentage of Si+Mn is controlled to be 0.5-1.9%, and Mn=(2.5-3.5)Si. The proportion of the pearlite and the bainite in the microstructure of the high-strength steel bar is proper.

Mn, Cr, Mo and Ni: As important solid solution strengthening elements in steel materials, appropriate alloying of Mn, Cr, Mo and Ni can improve hardenability and play a key role in formation of the pearlite and the bainite. When the mass percentage of Mn+Cr+Mo+Ni is lower than 1.1%, the hardenability of the steel bar is low, and formation of the pearlite and the bainite is not facilitated; when the mass percentage of Mn+Cr+Mo+Ni is higher than 2.1%, the low temperature toughness of the steel bar is low. Therefore, in this implementation, the mass percentage of Mn+Cr+Mo+Ni is controlled to be 1.1-2.1%, the high-strength steel bar has good hardenability and low-temperature toughness, and the structure performance of the pearlite and the bainite in the microstructure is good.

V: When V is added in an appropriate amount and the mass percentage of V is controlled to be 0.02-0.8% in this implementation, nano-level V (C, N) compounds can be precipitated during production (such as rolling) of the high-strength steel bar, and ferrite nucleation points are increased to prevent growth of ferrite grains; the strength is improved through precipitation of precipitates, growth of austenite grains in a welding heat-affected zone can be effectively prevented, and the toughness is improved; however, when too much V is added, the welding crack sensitivity of steel is improved.

Nb, Ti and Al: By adding Nb, Ti and Al into steel materials, on the one hand, the austenite grains in the microstructure of the high-strength steel bar can be refined, convenience is provided for adjusting transformation of the pearlite and the bainite, and fine grain strengthening and second phase strengthening play a role together; on the other hand, since Nb tends to segregate to the grain boundary, precipitation of nitrogen carbides of V in the grains is promoted, and coarsening is effectively prevented. Therefore, in this implementation, the mass percentage of at least one of Nb, Ti and Al is controlled to be 0.01-0.3%, and that is to say, in this implementation, the high-strength steel bar includes, by mass percentage, 0.01-0.3% of at least one or any of Nb, Ti and Al.

Compared with the prior art, especially compared with low-level steel bars, the high-strength steel bar in this implementation has the advantages that a reasonable alloying design of C, Si, Mn, Cr, Mo and Ni is adopted and combined with a microalloying design of Nb, V, Ti and Al, so that fine control over the microstructure is achieved; the steel bar has no obvious yield platform in a stress-strain curve of a tensile test, the yield strength≥600 Mpa, the yield ratio≤0.78, and continuous work hardening and uniform plastic deformation occur after the yield strength is reached so that the external disturbance resistance of a building can be significantly improved; in addition, the elongation after fracture≥25%, and the uniform elongation≥15% and is significantly higher than that of ordinary steel bars and seismic steel bars, so that great improvement of the deformation resistance of the building is facilitated; the impact toughness of the high-strength steel bar≥160 J under a test condition of −20° C. and is significantly higher than that of ordinary steel bars and seismic steel bars, and the high-strength steel bar absorbs more energy during deformation due to high toughness, so that the damage resistance of the building is improved; moreover, due to a low-carbon equivalent design of the high-strength steel bar, performance improvement during cold bending, welding and other processing applications is ensured.

In general, compared with low-level steel bars in the prior art, the high-strength steel bar has the advantages of a refined microstructure, no obvious yield platform, high yield strength, a low yield ratio, high elongation after fracture, high uniform elongation, high impact toughness under a test condition of −20° C., good welding performance and the like; the comprehensive performance is better, great improvement of the safety of major protection projects is facilitated, the steel bar is more suitable for major protection projects and other important building structures, safety levels of buildings during natural disasters and external damage can be significantly improved, consumption of the steel bar can be reduced at the same time, the application range is wide, and market competitiveness is high.

In a preferred implementation, the high-strength steel bar comprises, by mass percentage, the following chemical components: C: 0.15-0.29%, Si+Mn: 0.5-1.8%, Mn+Cr+Mo+Ni: 1.1-2.0%, V: 0.05-0.8%, at least one of Nb, Ti and Al: 0.01-0.3% and the balance of Fe and inevitable impurities; wherein Mn=(2.5-3.5)Si, and the carbon equivalent satisfies Ceq=C+Mn/6+(Cr+Mo+V)/5+(Cu+Ni)/15≤0.54%.

In other words, by optimizing the mass percentage of C to be 0.15-0.29%, the mass percentage of Si+Mn to be 0.5-1.8% and the mass percentage of Mn+Cr+Mo+Ni to be 1.1-2.0% and controlling the carbon equivalent Ceq to be not more than 0.54%, further improvement of the uniform elongation and the impact toughness under a test condition of −20° C. is facilitated.

In another preferred implementation, the high-strength steel bar comprises, by mass percentage, the following chemical components: C: 0.15-0.32%, Si+Mn: 0.5-1.6%, Cr: 0.3-0.6%, Mn+Cr+Mo+Ni: 1.3-2.0%, V: 0.02-0.8%, at least one of Nb, Ti and Al: 0.01-0.3% and the balance of Fe and inevitable impurities; wherein Mn=(2.5-3.5)Si, and the carbon equivalent satisfies Ceq=C+Mn/6+(Cr+Mo+V)/5+(Cu+Ni)/15≤0.56%.

In other words, by optimizing the mass percentage of Si+Mn to be 0.5-1.6% and the mass percentage of Mn+Cr+Mo+Ni to be 1.3-2.0% and controlling the mass percentage of Cr to be 0.3-0.6%, the strength of the high-strength steel bar can be effectively improved, and the elongation and welding crack sensitivity of the steel bar cannot be severely deteriorated due to excessive addition of Cr.

In another preferred implementation, the high-strength steel bar comprises, by mass percentage, the following chemical components: C: 0.15-0.32%, Si+Mn: 0.5-1.9%, Mn+Cr+Mo+Ni: 1.3-2.1%, V: 0.02-0.8%, B: 0.0008-0.002%, at least one of Nb, Ti and Al: 0.01-0.3% and the balance of Fe and inevitable impurities; wherein Mn=(2.5-3.5)Si, and the carbon equivalent satisfies Ceq=C+Mn/6+(Cr+Mo+V)/5+(Cu+Ni)/15≤0.56%.

In other words, by optimizing the mass percentage of Mn+Cr+Mo+Ni to be 1.3-2.1% and controlling the mass percentage of B to be 0.0008-0.002%, the solid solution element B is likely to segregate at an austenite grain boundary since a trace of B is added, the austenite grain boundary energy is reduced, formation of proeutectoid ferrite at the austenite grain boundary can be inhibited, nucleation of intragranular ferrite is promoted, and the toughness of the steel bar is improved; however, the strength of the steel bar is greatly improved when too much element B is added, and at the same time, the crack sensitivity is also greatly improved.

In addition, in the "another preferred implementation" above, components of Nb, Ti and Al are further optimized to include: at least one of Nb and Al: 0.01-0.3%, Ti: 0.01-0.1% and Ti/N≥1.5, and in this way, the yield of the added element B can be guaranteed; especially when the content of N in molten steel is high, N is likely to be combined with B; therefore, the mass percentage of Ti is controlled to be 0.01-0.1%, and Ti/N≥1.5 to avoid the situation that the yield of element B is too low.

Further, in the present invention, the high-strength steel bar is a threaded steel bar, the cross-sectional diameter is 14-18 mm, the content of C is 0.15-0.3% by mass percentage, and the carbon equivalent Ceq is 0.40-0.52%; or, the cross-sectional diameter is 20-22 mm, the content of C is 0.15-0.3% by mass percentage, and the carbon equivalent Ceq is 0.52-0.54%; in this way, improvement of the uniform elongation, impact toughness and weldability is facilitated.

Further, in an implementation of the present invention, the microstructure of the high-strength steel bar includes ferrite, pearlite, bainite and a precipitated phase.

In a specific implementation, the ferrite has a volume percentage of 5-35% and a size of 2-15 μm, the pearlite has a volume percentage of 30-70%, the bainite has a volume percentage of 5-35% and a size of 5-25 μm, and the precipitated phase has a size≤100 nm and a volume content≥$2*10^5/mm^3$.

Based on a large amount of experimental data, substructures of the microstructure of the high-strength steel bar are described in detail below.

Ferrite: The ferrite has good plasticity and toughness, and the strength can be improved due to strain hardening during stress induction. When the volume percentage of the ferrite is lower than 5%, the plasticity of the steel bar is reduced; when the volume percentage of the ferrite is higher than 35%, since plastic deformation occurs first in a stress process, the ferrite is likely to have an obvious yield platform, local deformation is caused, and thus the overall elongation is affected. When the size of the ferrite is lower than 2 μm, the production difficulty is high; when the size is higher than 15 μm, the yield strength is low, local deformation is caused, and thus the plasticity is reduced.

Pearlite: The pearlite has high strength and is mainly used to improve the fracture strength; however, the plasticity and the toughness are low. When the volume percentage of the pearlite is lower than 30%, the strength of the steel bar is low; when the volume percentage of the pearlite is higher than 70%, the plasticity and toughness of the steel bar are affected.

Bainite: The strength of the bainite is between that of the ferrite and the pearlite, the plasticity and toughness of the bainite are also between those of the ferrite and the pearlite, and the bainite is mainly used to coordinate deformation of the ferrite and the pearlite so that plastic deformation can be performed continuously and uniformly. When the volume percentage of the bainite is lower than 5%, the effect is not obvious; when the volume percentage of the bainite is higher than 35%, the fracture strength of the steel bar is affected. The strength is determined by the size of the bainite. When the size is lower than 5 μm, the strength is too high and difficult to control; when the size is higher than 25 μm, the uniformity of plastic deformation is affected, and thus the overall plasticity is deteriorated.

Precipitated phase: On the one hand, the precipitated phase can be used to strengthen the ferrite, and on the other hand, the yield platform can be removed by interaction between the precipitated phase and dislocations generated by deformation, so that a continuous and uniform plastic deformation process is achieved. The interaction between the precipitated phase and the dislocations is determined by the size and volume content of the precipitated phase, and thus the strain strengthening behavior and the strengthening effect are affected. When the size is higher than 100 nm, the strengthening effect of the precipitated phase is reduced. When the volume content is less than $2*10^5/mm^3$, on the one hand, the strengthening effect is not obvious, and on the other hand, the interaction between the precipitated phase and the dislocations is nonuniform, so that nonuniform plastic deformation is likely to be caused, and thus the plasticity is affected. Therefore, the volume content needs to be not less than $2*10^5/mm^3$.

In another preferred implementation, the ferrite has a volume percentage of 8-30% and a size of 3-12 μm, the pearlite has a volume percentage of 35-65%, the bainite has a volume percentage of 8-40% and a size of 6-22 μm, and the precipitated phase has a size≤80 nm and a volume content≥$5*10^5/mm^3$; in this way, the comprehensive mechanical performance of the high-strength steel bar can be further improved.

As a further improvement, the ferrite has a volume percentage of 10-25% and a size of 4-10 μm, the pearlite has a volume percentage of 40-60%, the bainite has a volume percentage of 15-35% and a size of 8-20 μm, and the precipitated phase has a size≤60 nm and a volume content≥$8*10^5/mm^3$, so that the comprehensive mechanical performance of the high-strength steel bar is further improved.

In addition, in the present invention, the high-strength steel bar includes a base material and a flash butt welding junction, and the high-strength steel bar has a fracture point formed at the base material in a tensile test. That is to say, a low carbon equivalent design is adopted for the high-strength steel bar, a flash butt welding process is used for welding connection, performance improvement during cold bending, welding and other processing applications is ensured, and the fracture point is formed at the base material in the tensile test.

In addition, the present invention also provides a production method of the high-strength steel bar above. The production method includes the processes of smelting, casting, temperature-controlled rolling and temperature-controlled cooling which are performed in sequence to obtain the high-strength steel bar, and each process in the production method is described in detail below.

(1) Smelting process: molten steel is subjected to smelting in an electric furnace or a converter so that the quality of the molten steel and the precision of chemical components can be ensured;

(2) continuous casting process: the molten steel is prepared into a continuous casting billet through a continuous casting machine, and the superheat degree of the molten steel during continuous casting is 15-30° C.;

it is found through experimental researches that when the superheat degree of the molten steel is higher than 30° C., there are problems such as bonding steel leakage, surface cracks, segregation and looseness; when the superheat degree of the molten steel is lower than 15° C., impurities in the molten steel are likely to be increased, and a tendency of having cold solder joints on the surface of the continuous casting billet is increased; when the superheat degree of the molten steel is controlled to be 15-30° C., these problems can be avoided well;

(3) temperature-controlled rolling process: a hot rolling process is preferably used to roll the continuous casting billet into the steel bar in a heating furnace at a heating temperature of 1200-1250° C. for 60-120 min, the initial rolling temperature is 1000-1150° C., and the finish rolling temperature is 850-950° C.;

it is found through experimental researches that when the continuous casting billet is heated in the heating furnace at a heating temperature of higher than 1250° C. for more than 120 min, the size of original austenite grains is large; when the continuous casting billet is heated in the heating furnace at a heating temperature of lower than 1200° C. for less than 60 min, uniform treatment of alloying elements is not facilitated, and when the continuous casting billet contains element Nb, dissolution and precipitation strengthening of element Nb are also not facilitated;

in addition, it is found through experimental researches that when the initial rolling temperature is controlled to be 1000-1150° C. and the finish rolling temperature is controlled to be 850-950° C., convenience is provided for controlling the grain size;

(4) temperature-controlled cooling process: the steel bar at a temperature of 800-920° C. is cooled on a cooling bed;

it is found through experimental researches that when the steel bar at a temperature of higher than 920° C. is cooled on the cooling bed, the proportion of the ferrite in the microstructure is too large, and the strength of the steel bar is affected; when the steel bar at a temperature of lower than 800° C. is cooled on the cooling bed, the proportion of the bainite in the microstructure is large, and the elongation and impact toughness of the steel bar are greatly reduced.

In general, in an implementation of the present invention, the high-strength steel bar of the present invention can be prepared by using the production method; as described above, the high-strength steel bar has no obvious yield platform, the yield strength≥600 Mpa, the yield ratio≤0.78, the elongation after fracture≥25%, the uniform elongation≥15%, and the impact toughness≥160 J under a test condition of −20° C.; the high-strength steel bar includes, by mass percentage, the following chemical components: C: 0.15-0.32%, Si+Mn: 0.5-1.9%, Mn+Cr+Mo+Ni: 1.1-2.1%, V: 0.02-0.8%, at least one of Nb, Ti and Al: 0.01-0.3% and the balance of Fe and inevitable impurities; where Mn=(2.5-3.5)Si, and a carbon equivalent satisfies Ceq=C+Mn/6+(Cr+Mo+V)/5+(Cu+Ni)/15≤0.56%.

Further, in the smelting process, the molten steel is preferably subjected to smelting in a converter; in a specific implementation, according to the target chemical components, a metal nickel plate is added to the bottom of a steel ladle for alloying before tapping from the converter, and a ferrosilicon alloy, a silico-manganese alloy, low-carbon ferrochrome and ferromolybdenum are sequentially added for deoxidation and alloying when ⅓ of tapping is completed, where the added amount of the ferrosilicon alloy and the silico-manganese alloy is appropriately adjusted according to the actually used alloy components and the content of remaining Si and Mn; after white slag is subjected to refining for 3 min, at least one of ferroniobium, ferro-titanium and an aluminum wire is fed, and a vanadium-nitrogen alloy is fed for microalloying.

Preferably, the smelting process further includes an argon blowing refining process. According to the argon blowing refining process, argon bottom blowing at a pressure of 0.4-0.6 MPa is used to perform soft stirring on the refined molten steel for not less than 5 min; in this way, deoxidation and alloying of the molten steel can be completed during refining, and the uniformity of alloying elements in the molten steel can be further improved by argon blowing soft stirring.

Further, in the continuous casting process, the continuous casting machine includes a crystallizer and a stirring device arranged in the crystallizer, and the molten steel is subjected to electromagnetic stirring during continuous casting with an electromagnetic stirring parameter of 300 A/4 Hz and a final electromagnetic stirring parameter of 480 A/10 Hz. By setting the electromagnetic stirring parameter to be 300 A/4 Hz, the segregation degree can be reduced, and the nucleation point can be increased; in addition, by setting the final electromagnetic stirring parameter to be 480 A/10 Hz, the range of an equiaxed crystal zone can be expanded, and the looseness and the shrinkage are reduced.

In addition, preferably, in the continuous casting process, the straightening temperature of the continuous casting billet≥850° C. It is found through experimental researches that when the straightening temperature is lower than 850° C., the deformation resistance of the continuous casting billet is too high during straightening of the continuous casting billet, and the surface quality of the continuous casting billet is reduced; when the straightening temperature of the continuous casting billet is not higher than 850° C., the surface quality of the continuous casting billet can be guaranteed.

Further, in the temperature-controlled cooling process, the steel bar at a temperature of 820-900° C. is preferably cooled on the cooling bed at a cooling rate of 2-5° C./s. By optimizing the temperature and cooling rate on the cooling bed, the microstructure can be further optimized, and the strength, elongation, impact toughness and other performances of the steel bar can be ensured.

As described above, the present invention is realized based on a large number of experimental researches and further described below through specific test examples. The test examples include 21 embodiments with serial numbers 1-16, 18-22 and 5 comparative examples with serial numbers 23-27 in total. A specific production method is as follows.

(1) Smelting Process

A smelting furnace shown in Table 1 is used for smelting of molten steel;

deoxidation and alloying are performed on the molten steel according to target chemical components and specifically include the steps that a metal nickel plate is added to the bottom of a steel ladle for alloying before tapping, and a ferrosilicon alloy, a silico-manganese alloy, low-carbon ferrochrome and ferromolybdenum are sequentially added for deoxidation and alloying when ⅓ of tapping is completed, where the added amount of the ferrosilicon alloy and the silico-manganese alloy is appropriately adjusted according to the actually used alloy components and the content of remaining Si and Mn; after white slag is subjected to refining for 3 min, at least one of ferroniobium, ferro-titanium and an aluminum wire is fed as shown in Table 1, and a vanadium-nitrogen alloy is fed for microalloying; in this process, whether a ferro-boron alloy is fed or not is controlled as shown in Table 1.

Then, as shown in Table 1, argon bottom blowing is used to perform soft stirring on the refined molten steel.

TABLE 1

| No. | | Smelting Furnace | Ferro-niobium | Ferro-Titanium | Aluminum Wire | Ferro-Boron |
|---|---|---|---|---|---|---|
| Embodiments | 1# | Electric Furnace | Yes | / | / | / |
| | 2# | Electric Furnace | / | Yes | / | / |
| | 3# | Electric Furnace | / | / | / | / |
| | 4# | Electric Furnace | / | / | Yes | / |
| | 5# | Converter | / | Yes | Yes | / |
| | 6# | Converter | Yes | / | / | / |
| | 7# | Converter | Yes | Yes | / | / |
| | 8# | Converter | / | / | Yes | / |
| | 9# | Converter | Yes | / | / | / |
| | 10# | Converter | / | / | / | / |
| | 11# | Converter | Yes | / | Yes | / |
| | 12# | Converter | / | Yes | Yes | / |
| | 13# | Converter | Yes | / | / | / |
| | 14# | Converter | / | / | / | / |
| | 15# | Converter | / | / | / | / |
| | 16# | Converter | / | / | / | Yes |
| | 17# | Converter | Yes | / | / | Yes |
| | 18# | Converter | / | Yes | Yes | Yes |
| | 19# | Converter | / | / | / | Yes |
| | 20# | Converter | Yes | Yes | / | Yes |
| | 21# | Converter | / | Yes | Yes | Yes |
| | 22# | Converter | / | / | / | Yes |
| Comparative Examples | 23# | Converter | / | / | Yes | / |
| | 24# | Electric Furnace | Yes | / | / | Yes |
| | 25# | Electric Furnace | Yes | / | / | / |
| | 26# | Converter | / | Yes | Yes | Yes |
| | 27# | Electric Furnace | Yes | Yes | Yes | / |

(2) Continuous Casting Process:

The molten steel is prepared into a continuous casting billet with specifications shown in Table 2 through a continuous casting machine, and the superheat degree of the molten steel during continuous casting is controlled as shown in Table 2; the molten steel is subjected to electromagnetic stirring during continuous casting with an electromagnetic stirring parameter of 300 A/4 Hz and a final electromagnetic stirring parameter of 480 A/10 Hz; the straightening temperature of the continuous casting billet is controlled as shown in Table 2.

TABLE 2

| No. | | Specifications/ mm | Superheat Degree/ ° C. | Straightening Temperature/ ° C. |
|---|---|---|---|---|
| Embodiments | 1# | 140 Square Billet | 15 | 850 |
| | 2# | 140 Square Billet | 15 | 850 |
| | 3# | 140 Square Billet | 15 | 851 |
| | 4# | 140 Square Billet | 17 | 853 |
| | 5# | 140 Square Billet | 18 | 855 |
| | 6# | 150 Square Billet | 18 | 858 |
| | 7# | 150 Square Billet | 20 | 859 |
| | 8# | 150 Square Billet | 21 | 859 |
| | 9# | 150 Square Billet | 22 | 860 |
| | 10# | 150 Square Billet | 23 | 863 |
| | 11# | 150 Square Billet | 23 | 864 |
| | 12# | 150 Square Billet | 24 | 865 |
| | 13# | 150 Square Billet | 24 | 866 |
| | 14# | 150 Square Billet | 24 | 866 |
| | 15# | 150 Square Billet | 25 | 867 |
| | 16# | 150 Square Billet | 25 | 869 |
| | 17# | 150 Square Billet | 26 | 872 |
| | 18# | 150 Square Billet | 26 | 873 |
| | 19# | 150 Square Billet | 28 | 873 |
| | 20# | 150 Square Billet | 29 | 874 |
| | 21# | 150 Square Billet | 30 | 877 |
| | 22# | 150 Square Billet | 30 | 880 |
| Comparative Examples | 23# | 150 Square Billet | 14 | 846 |
| | 24# | 140 Square Billet | 38 | 844 |
| | 25# | 140 Square Billet | 46 | 835 |
| | 26# | 150 Square Billet | 43 | 837 |
| | 27# | 150 Square Billet | 37 | 829 |

(3) Temperature-Controlled Rolling Process:

The continuous casting billet is rolled into the steel bar with diameter shown in Table 3 on a threaded steel bar rolling machine, and the heating temperature and time of the continuous casting billet in a heating furnace, the initial rolling temperature and the finish rolling temperature are controlled as shown in Table 3.

TABLE 3

| No. | | Diameter/ mm | Heating Temperature/ ° C. | Time/ min | Initial Rolling Temperature/ ° C. | Finish Rolling Temperature/ ° C. |
|---|---|---|---|---|---|---|
| Embodiments | 1# | 16 | 1200 | 60 | 1000 | 850 |
| | 2# | 16 | 1200 | 60 | 1005 | 854 |
| | 3# | 18 | 1205 | 61 | 1007 | 855 |
| | 4# | 18 | 1206 | 63 | 1010 | 858 |
| | 5# | 20 | 1212 | 65 | 1012 | 862 |
| | 6# | 22 | 1219 | 69 | 1016 | 865 |
| | 7# | 20 | 1220 | 75 | 1024 | 869 |
| | 8# | 22 | 1223 | 77 | 1027 | 871 |
| | 9# | 22 | 1229 | 79 | 1031 | 883 |
| | 10# | 20 | 1231 | 85 | 1036 | 885 |
| | 11# | 22 | 1233 | 94 | 1066 | 888 |
| | 12# | 22 | 1234 | 97 | 1070 | 897 |
| | 13# | 20 | 1234 | 98 | 1073 | 897 |
| | 14# | 22 | 1234 | 100 | 1078 | 899 |
| | 15# | 22 | 1235 | 103 | 1085 | 904 |
| | 16# | 28 | 1235 | 105 | 1089 | 931 |
| | 17# | 25 | 1241 | 109 | 1090 | 933 |
| | 18# | 25 | 1244 | 112 | 1114 | 934 |
| | 19# | 28 | 1247 | 118 | 1115 | 941 |
| | 20# | 25 | 1248 | 118 | 1126 | 944 |
| | 21# | 25 | 1250 | 120 | 1150 | 946 |
| | 22# | 28 | 1250 | 120 | 1150 | 950 |

TABLE 3-continued

| No. | | Diameter/ mm | Heating Temperature/ ° C. | Time/ min | Initial Rolling Temperature/ ° C. | Finish Rolling Temperature/ ° C. |
|---|---|---|---|---|---|---|
| Comparative Examples | 23# | 16 | 1180 | 58 | 980 | 834 |
| | 24# | 18 | 1186 | 122 | 985 | 831 |
| | 25# | 20 | 1255 | 55 | 1161 | 964 |
| | 26# | 20 | 1253 | 127 | 1157 | 971 |
| | 27# | 28 | 1191 | 45 | 994 | 843 |

(4) Temperature-Controlled Cooling Process:

The steel bar at a temperature is cooled on a cooling bed and a cooling rate as shown in Table 4.

TABLE 4

| No. | | Temperature/ ° C. | Cooling Rate/ ° C. |
|---|---|---|---|
| Embodiments | 1# | 800 | 2.0 |
| | 2# | 807 | 2.1 |
| | 3# | 812 | 2.1 |
| | 4# | 815 | 2.3 |
| | 5# | 819 | 2.4 |
| | 6# | 820 | 2.5 |
| | 7# | 823 | 2.6 |
| | 8# | 826 | 2.8 |
| | 9# | 834 | 2.9 |
| | 10# | 836 | 3.2 |
| | 11# | 841 | 3.5 |
| | 12# | 847 | 3.6 |
| | 13# | 848 | 3.7 |
| | 14# | 853 | 3.8 |
| | 15# | 859 | 3.9 |
| | 16# | 864 | 4.1 |
| | 17# | 871 | 4.3 |
| | 18# | 887 | 4.4 |
| | 19# | 891 | 4.6 |
| | 20# | 892 | 4.7 |
| | 21# | 909 | 4.8 |
| | 22# | 920 | 5.0 |
| Comparative Examples | 23# | 797 | Natural Cooling |
| | 24# | 789 | Natural Cooling |
| | 25# | 931 | Natural Cooling |
| | 26# | 925 | Natural Cooling |
| | 27# | 786 | Natural Cooling |

The chemical components, microstructure and tensile property of the steel bar prepared by using the production method are detected and tested, and results are shown in Table 5, Table 6 and Table 7 respectively; after the prepared steel bar is subjected to welding by using a flash butt welding process, the tensile property of a welded steel bar sample is tested, and results are shown in Table 8.

TABLE 5

| No. | | C | Si | Mn | Cr | Mo | Ni | Nb | V | Ti | Al | B | Ceq |
|---|---|---|---|---|---|---|---|---|---|---|---|---|---|
| Embodiments | 1# | 0.19 | 0.31 | 1.09 | 0.23 | 0.01 | 0.35 | 0.000 | 0.270 | 0.010 | 0.021 | / | 0.50 |
| | 2# | 0.16 | 0.36 | 1.23 | 0.14 | 0.10 | 0.39 | 0.050 | 0.291 | 0.000 | 0.024 | / | 0.50 |
| | 3# | 0.28 | 0.17 | 0.51 | 0.58 | 0.06 | 0.29 | 0.145 | 0.050 | 0.035 | 0.052 | / | 0.52 |
| | 4# | 0.19 | 0.41 | 1.39 | 0.01 | 0.02 | 0.36 | 0.010 | 0.345 | 0.300 | 0.000 | / | 0.52 |
| | 5# | 0.15 | 0.14 | 0.36 | 0.60 | 0.03 | 0.51 | 0.300 | 0.800 | 0.000 | 0.000 | / | 0.53 |
| | 6# | 0.29 | 0.18 | 0.59 | 0.13 | 0.36 | 0.59 | 0.000 | 0.050 | 0.141 | 0.010 | / | 0.54 |
| | 7# | 0.17 | 0.44 | 1.23 | 0.27 | 0.08 | 0.52 | 0.000 | 0.153 | 0.000 | 0.300 | / | 0.51 |
| | 8# | 0.28 | 0.20 | 0.50 | 0.15 | 0.08 | 0.37 | 0.030 | 0.446 | 0.141 | 0.000 | / | 0.52 |
| | 9# | 0.28 | 0.18 | 0.45 | 0.30 | 0.31 | 0.24 | 0.000 | 0.310 | 0.201 | 0.126 | / | 0.56 |
| | 10# | 0.18 | 0.13 | 0.37 | 0.51 | 0.22 | 0.35 | 0.047 | 0.725 | 0.021 | 0.300 | / | 0.56 |
| | 11# | 0.18 | 0.41 | 1.03 | 0.30 | 0.02 | 0.61 | 0.000 | 0.509 | 0.154 | 0.000 | / | 0.56 |
| | 12# | 0.15 | 0.21 | 0.49 | 0.60 | 0.03 | 0.51 | 0.300 | 0.800 | 0.000 | 0.000 | / | 0.55 |
| | 13# | 0.32 | 0.17 | 0.53 | 0.13 | 0.36 | 0.59 | 0.000 | 0.020 | 0.141 | 0.010 | / | 0.55 |
| | 14# | 0.23 | 0.45 | 1.15 | 0.03 | 0.13 | 0.50 | 0.178 | 0.322 | 0.010 | 0.025 | / | 0.55 |
| | 15# | 0.18 | 0.28 | 0.90 | 0.35 | 0.32 | 0.43 | 0.010 | 0.357 | 0.300 | 0.067 | / | 0.56 |
| | 16# | 0.18 | 0.42 | 1.40 | 0.01 | 0.13 | 0.33 | 0.072 | 0.362 | 0.033 | 0.133 | 0.0020 | 0.54 |
| | 17# | 0.32 | 0.12 | 0.38 | 0.13 | 0.26 | 0.53 | 0.000 | 0.210 | 0.300 | 0.010 | 0.0020 | 0.54 |
| | 18# | 0.15 | 0.24 | 0.84 | 0.30 | 0.03 | 0.51 | 0.300 | 0.800 | 0.000 | 0.000 | 0.0020 | 0.55 |
| | 19# | 0.24 | 0.35 | 1.19 | 0.01 | 0.20 | 0.27 | 0.053 | 0.211 | 0.010 | 0.300 | 0.0016 | 0.54 |
| | 20# | 0.19 | 0.40 | 1.19 | 0.15 | 0.22 | 0.42 | 0.000 | 0.321 | 0.000 | 0.198 | 0.0008 | 0.55 |
| | 21# | 0.21 | 0.42 | 1.17 | 0.13 | 0.20 | 0.35 | 0.253 | 0.271 | 0.000 | 0.000 | 0.0011 | 0.55 |
| | 22# | 0.21 | 0.45 | 1.45 | 0.11 | 0.21 | 0.33 | 0.010 | 0.020 | 0.100 | 0.167 | 0.0020 | 0.54 |
| Comparative Examples | 23# | 0.12 | 0.41 | 1.39 | 0.01 | 0.02 | 0.36 | 0.010 | 0.345 | 0.300 | 0.000 | / | 0.45 |
| | 24# | 0.32 | 0.12 | 0.18 | 0.13 | 0.26 | 0.53 | 0.000 | 0.210 | 0.300 | 0.010 | 0.0020 | 0.51 |
| | 25# | 0.28 | 0.18 | 0.45 | 0.10 | 0.11 | 0.24 | 0.000 | 0.310 | 0.201 | 0.126 | / | 0.48 |
| | 26# | 0.15 | 0.24 | 0.84 | 0.30 | 0.03 | 0.51 | 0.300 | 0.000 | 0.000 | 0.000 | 0.0020 | 0.39 |
| | 27# | 0.16 | 0.36 | 1.23 | 0.14 | 0.10 | 0.39 | 0.000 | 0.291 | 0.000 | 0.000 | / | 0.50 |

TABLE 6

| No. | | Volume Percentage of F/% | Size of F/μm | Volume Percentage of P/% | Volume Percentage of B/% | Size of B/μm | Size of Precipitated Phase/nm | Volume Content/ 10*5 |
|---|---|---|---|---|---|---|---|---|
| Embodiments | 1# | 10 | 4.4 | 60 | 30 | 8.0 | 44.5 | 8.0 |
| | 2# | 23 | 5.1 | 42 | 35 | 9.6 | 55.1 | 8.9 |
| | 3# | 20 | 4.0 | 57 | 23 | 10.6 | 53.6 | 9.2 |
| | 4# | 8 | 3.0 | 64 | 20 | 6.0 | 64.3 | 7.7 |
| | 5# | 10 | 4.7 | 65 | 26 | 21.0 | 65.8 | 7.5 |
| | 6# | 15 | 6.4 | 50 | 25 | 21.5 | 63.4 | 6.9 |
| | 7# | 5 | 2.7 | 63 | 32 | 8.8 | 88.0 | 4.8 |
| | 8# | 6 | 2.0 | 70 | 26 | 5.0 | 87.2 | 4.3 |
| | 9# | 19 | 8.5 | 59 | 22 | 20.0 | 57.5 | 10.7 |
| | 10# | 25 | 9.8 | 60 | 15 | 19.2 | 59.7 | 8.5 |
| | 11# | 28 | 10.3 | 64 | 8 | 10.2 | 72.0 | 5.8 |
| | 12# | 30 | 12.0 | 35 | 40 | 22.0 | 80.0 | 5.0 |
| | 13# | 16 | 5.2 | 59 | 14 | 22.7 | 89.9 | 3.5 |
| | 14# | 33 | 7.2 | 30 | 34 | 13.6 | 100.0 | 3.6 |
| | 15# | 25 | 13.1 | 55 | 20 | 25.0 | 87.7 | 3.2 |
| | 16# | 18 | 10.0 | 40 | 15 | 15.5 | 60.0 | 11.3 |
| | 17# | 11 | 15.1 | 19 | 70 | 19.1 | 135.1 | 0.8 |
| | 18# | 10 | 4.7 | 46 | 26 | 7.9 | 65.8 | 7.5 |
| | 19# | 15 | 6.4 | 60 | 25 | 9.5 | 63.4 | 6.9 |
| | 20# | 16 | 15.0 | 59 | 25 | 16.9 | 91.9 | 2.0 |
| | 21# | 33 | 7.6 | 33 | 34 | 17.0 | 96.0 | 2.3 |
| | 22# | 35 | 13.7 | 59 | 5 | 18.4 | 98.0 | 2.4 |
| Comparative Examples | 23# | 21 | 8.9 | 72 | 7 | 20.4 | 157.6 | 1.7 |
| | 24# | 38 | 13.4 | 45 | 17 | 25.3 | 179.2 | 1.5 |
| | 25# | 14 | 17.1 | 48 | 38 | 19.2 | 141.0 | 1.0 |
| | 26# | 46 | 15.8 | 35 | 19 | 26.9 | 108.3 | 0.4 |
| | 27# | 26 | 15.3 | 46.5 | 27.5 | 22.3 | 160.1 | 1.3 |

It should be noted that in Table 6, F refers to ferrite, P refers to pearlite and B refers to bainite.

TABLE 7

| No. | | Yield Strength/ MPa | Tensile Strength/ MPa | Yield Ratio | Uniform Elongation/ % | Elongation After Fracture/ % | Akv- 20° C./J |
|---|---|---|---|---|---|---|---|
| Embodiments | 1# | 649 | 929 | 0.69 | 17.1 | 27.1 | 225 |
| | 2# | 649 | 931 | 0.69 | 16.9 | 27.0 | 222 |
| | 3# | 647 | 945 | 0.71 | 16.7 | 26.6 | 200 |
| | 4# | 644 | 971 | 0.70 | 16.6 | 26.5 | 206 |
| | 5# | 644 | 944 | 0.69 | 16.5 | 26.5 | 206 |
| | 6# | 643 | 935 | 0.68 | 16.5 | 26.5 | 207 |
| | 7# | 638 | 927 | 0.69 | 16.4 | 26.1 | 208 |
| | 8# | 635 | 939 | 0.69 | 15.9 | 26.1 | 215 |
| | 9# | 670 | 874 | 0.77 | 15.8 | 25.9 | 180 |
| | 10# | 670 | 915 | 0.74 | 15.7 | 25.7 | 185 |
| | 11# | 669 | 915 | 0.70 | 15.5 | 25.5 | 177 |
| | 12# | 668 | 899 | 0.72 | 15.4 | 25.6 | 170 |
| | 13# | 660 | 893 | 0.70 | 15.3 | 25.3 | 172 |
| | 14# | 656 | 905 | 0.74 | 15.2 | 25.2 | 173 |
| | 15# | 650 | 971 | 0.69 | 15.2 | 25.3 | 164 |
| | 16# | 689 | 945 | 0.71 | 18.2 | 27.1 | 168 |
| | 17# | 683 | 945 | 0.72 | 17.9 | 27.8 | 236 |
| | 18# | 681 | 905 | 0.72 | 17.6 | 27.7 | 237 |
| | 19# | 675 | 929 | 0.73 | 17.4 | 27.5 | 225 |
| | 20# | 672 | 915 | 0.71 | 17.3 | 27.4 | 229 |
| | 21# | 671 | 909 | 0.71 | 17.1 | 27.2 | 228 |
| | 22# | 649 | 922 | 0.73 | 15.0 | 27.0 | 221 |
| Comparative Examples | 23# | 562 | 723 | 0.78 | 12.9 | 14.0 | 161 |
| | 24# | 617 | 784 | 0.79 | 13.4 | 16.4 | 49 |
| | 25# | 619 | 853 | 0.73 | 13.0 | 17.2 | 37 |
| | 26# | 625 | 778 | 0.80 | 13.5 | 17.1 | 22 |
| | 27# | 350 | 615 | 0.57 | 17.1 | 18.4 | 46 |

TABLE 8

| No. | | Yield Strength/ MPa | Tensile Strength/ MPa | Yield Ratio | Uniform Elongation/ % | Elongation After Fracture/ % | Akv- 20° C./J | Fracture Point |
|---|---|---|---|---|---|---|---|---|
| Embodiments | 1# | 648 | 943 | 0.69 | 17.7 | 27.1 | 247 | Base Material |
| | 2# | 650 | 952 | 0.68 | 17.5 | 27.5 | 236 | Base Material |
| | 3# | 649 | 926 | 0.70 | 17.5 | 27.3 | 228 | Base Material |
| | 4# | 644 | 908 | 0.71 | 17.4 | 27.0 | 222 | Base Material |
| | 5# | 643 | 957 | 0.67 | 16.6 | 25.9 | 218 | Base Material |
| | 6# | 641 | 936 | 0.68 | 16.5 | 27.5 | 216 | Base Material |
| | 7# | 641 | 936 | 0.68 | 16.0 | 27.6 | 215 | Base Material |
| | 8# | 639 | 908 | 0.70 | 15.2 | 26.1 | 214 | Base Material |
| | 9# | 655 | 945 | 0.69 | 15.0 | 26.4 | 213 | Base Material |
| | 10# | 651 | 899 | 0.72 | 15.7 | 26.5 | 207 | Base Material |
| | 11# | 652 | 965 | 0.68 | 17.3 | 25.2 | 183 | Base Material |
| | 12# | 653 | 922 | 0.71 | 15.9 | 25.8 | 178 | Base Material |
| | 13# | 655 | 934 | 0.70 | 15.9 | 25.7 | 170 | Base Material |
| | 14# | 656 | 957 | 0.69 | 16.8 | 25.1 | 170 | Base Material |
| | 15# | 657 | 992 | 0.66 | 17.2 | 25.9 | 167 | Base Material |
| | 16# | 683 | 878 | 0.78 | 16.3 | 27.3 | 214 | Base Material |
| | 17# | 683 | 985 | 0.69 | 16.4 | 26.7 | 212 | Base Material |
| | 18# | 675 | 893 | 0.76 | 15.8 | 26.3 | 195 | Base Material |
| | 19# | 672 | 918 | 0.73 | 15.9 | 26.1 | 191 | Base Material |
| | 20# | 660 | 932 | 0.71 | 15.5 | 27.0 | 190 | Base Material |
| | 21# | 660 | 888 | 0.74 | 15.3 | 26.2 | 186 | Base Material |
| | 22# | 660 | 878 | 0.75 | 15.7 | 25.7 | 184 | Base Material |
| Comparative Examples | 23# | 557 | 723 | 0.77 | 12.9 | 14.0 | 171 | Welding Point |
| | 24# | 601 | 784 | 0.77 | 13.4 | 16.4 | 46 | Welding Point |
| | 25# | 629 | 853 | 0.74 | 13.0 | 17.2 | 32 | Welding Point |
| | 26# | 613 | 778 | 0.79 | 13.5 | 17.1 | 50 | Welding Point |
| | 27# | 357 | 615 | 0.58 | 17.1 | 18.4 | 54 | Welding Point |

It can be seen from Table 7 that according to an implementation of the present invention, the high-strength steel bars in Embodiments 1-16 and 18-22 have no obvious yield platform, the yield strength of the steel bars≥600 MPa, the yield ratio≤0.78, the uniform elongation≥15%, the impact toughness≥160 J under a test condition of −20° C., and the performance of the high-strength steel bars is higher than that of existing steel bars in Comparative Examples 23-27; in addition, it can be seen from Table 7 that according to an implementation of the present invention, the high-strength steel bars in Embodiments 1-16 and 18-22 have excellent welding performance, the yield strength after welding≥600

MPa, the yield ratio≤0.78, the uniform elongation≥15%, and the impact toughness≥160 J under a test condition of −20° C.

What is claimed is:

1. A high-strength steel bar, comprising, by mass percentage, the following chemical components: C: 0.15-0.32%, Si+Mn: 0.5-1.9%, Mn+Cr+Mo+Ni: 1.1-2.1%, V: 0.02-0.8%, at least one of Nb, Ti and Al: 0.01-0.3%, and a balance of Fe and inevitable impurities; wherein Mn=(2.5-3.5)Si, and a carbon equivalent satisfies Ceq=C+Mn/6+(Cr+Mo+V)/5+(Cu+Ni)/15≤0.56%;

a microstructure of the high-strength steel bar comprises ferrite, pearlite, bainite and a precipitated phase;

the ferrite has a volume percentage of 5-35% and a size of 2-15 μm, the pearlite has a volume percentage of 30-70%, the bainite has a volume percentage of 5-35% and a size of 5-25 μm;

the high-strength steel bar has a yield strength≥600 MPa, a yield ratio≤0.78, an elongation after fracture≥25%, and an uniform elongation≥15%.

2. The high-strength steel bar according to claim 1, comprising, by mass percentage, the following chemical components: C: 0.15-0.29%, Si+Mn: 0.5-1.8%, Mn+Cr+Mo+Ni: 1.1-2.0%, V: 0.05-0.8%, at least one of Nb, Ti and Al: 0.01-0.3% and the balance of Fe and inevitable impurities; wherein Mn=(2.5-3.5)Si, and the carbon equivalent satisfies Ceq=C+Mn/6+(Cr+Mo+V)/5+(Cu+Ni)/15≤0.54%.

3. The high-strength steel bar according to claim 1, comprising, by mass percentage, the following chemical components: C: 0.15-0.32%, Si+Mn: 0.5-1.6%, Cr: 0.3-0.6%, Mn+Cr+Mo+Ni: 1.3-2.0%, V: 0.02-0.8%, at least one of Nb, Ti and Al: 0.01-0.3% and the balance of Fe and inevitable impurities; wherein Mn=(2.5-3.5)Si, and the carbon equivalent satisfies Ceq=C+Mn/6+(Cr+Mo+V)/5+(Cu+Ni)/15≤0.56%.

4. The high-strength steel bar according to claim 1, comprising, by mass percentage, the following chemical components: C: 0.15-0.32%, Si+Mn: 0.5-1.9%, Mn+Cr+Mo+Ni: 1.3-2.1%, V: 0.02-0.8%, B: 0.0008-0.002%, at least one of Nb, Ti and Al: 0.01-0.3% and the balance of Fe and inevitable impurities; wherein Mn=(2.5-3.5)Si, and the carbon equivalent satisfies Ceq=C+Mn/6+(Cr+Mo+V)/5+(Cu+Ni)/15≤0.56%.

5. The high-strength steel bar according to claim 4, comprising, by mass percentage, the following chemical components: C: 0.15-0.32%, Si+Mn: 0.5-1.9%, Mn+Cr+Mo+Ni: 1.1-2.1%, V: 0.02-0.8%, B: 0.0008-0.002%, at least one of Nb and Al: 0.01-0.3%, Ti: 0.01-0.1% and the balance of Fe and inevitable impurities; wherein Ti/N≥1.5, Mn=(2.5-3.5)Si, and the carbon equivalent satisfies Ceq=C+Mn/6+(Cr+Mo+V)/5+(Cu+Ni)/15≤0.56%.

6. The high-strength steel bar according to claim 1, wherein the cross-sectional diameter of the high-strength steel bar is 14-18 mm, the content of C is 0.15-0.3% by mass percentage, and the carbon equivalent Ceq is 0.40-0.52%; or the cross-sectional diameter of the high-strength steel bar is 20-22 mm, the content of C is 0.15-0.3% by mass percentage, and the carbon equivalent Ceq is 0.52-0.54%.

7. The high-strength steel bar according to claim 1, wherein the precipitated phase has a size≤100 nm and a volume content≥$2*10^5/mm^3$.

8. The high-strength steel bar according to claim 1, wherein the ferrite has a volume percentage of 8-30% and a size of 3-12 μm, the pearlite has a volume percentage of 35-65%, the bainite has a volume percentage of 8-35% and a size of 6-22 μm, and the precipitated phase has a size≤80 nm and a volume content≥$5*10^5/mm^3$.

9. The high-strength steel bar according to claim 1, wherein the ferrite has a volume percentage of 10-25% and a size of 4-10 μm, the pearlite has a volume percentage of 40-60%, the bainite has a volume percentage of 15-35% and a size of 8-20 μm, and the precipitated phase has a size≤60 nm and a volume content≥$8*10^5/mm^3$.

10. The high-strength steel bar according to claim 1, wherein the high-strength steel bar has no obvious yield platform in a stress-strain curve of a tensile test and an impact toughness≥160 J under a test condition of −20° C.

11. The high-strength steel bar according to claim 1, wherein the high-strength steel bar comprises a base material and a flash butt welding junction, and the high-strength steel bar has a fracture point formed at the base material in a tensile test.

12. A production method of the high-strength steel bar according to claim 1, wherein the production method comprises the following steps:

a smelting process: performing smelting on molten steel in an electric furnace or a converter;

a continuous casting process: preparing the molten steel into a continuous casting billet through a continuous casting machine, wherein the superheat degree of the molten steel during continuous casting is 15-30° C.;

a temperature-controlled rolling process: rolling the continuous casting billet into the steel bar in a heating furnace at a heating temperature of 1200-1250° C. for 60-120 min, wherein the initial rolling temperature is 1000-1150° C., and the finish rolling temperature is 850-950° C.;

a temperature-controlled cooling process: cooling the steel bar at a temperature of 800-920° C. on a cooling bed.

13. The production method of the high-strength steel bar according to claim 12, wherein the smelting process comprises an argon blowing refining process, and according to the argon blowing refining process, argon bottom blowing at a pressure of 0.4-0.6 MPa is used to perform soft stirring on the refined molten steel for not less than 5 min.

14. The production method of the high-strength steel bar according to claim 12, wherein the molten steel is subjected to electromagnetic stirring during continuous casting with an electromagnetic stirring parameter of 300 A/4 Hz and a final electromagnetic stirring parameter of 480 A/10 Hz.

15. The production method of the high-strength steel bar according to claim 12, wherein in the continuous casting process, the straightening temperature of the continuous casting billet≥850° C.

16. The production method of the high-strength steel bar according to claim 12, wherein in the temperature-controlled cooling process, the steel bar at a temperature of 820-900° C. is cooled on the cooling bed at a cooling rate of 2-5° C./s.

* * * * *